US008242977B2

(12) United States Patent
Kuriyama

(10) Patent No.: US 8,242,977 B2
(45) Date of Patent: Aug. 14, 2012

(54) PLASMA DISPLAY APPARATUS WITH DRIVING AND CONTROLLING CIRCUIT UNIT

(75) Inventor: Hirohito Kuriyama, Miyazaki (JP)

(73) Assignee: Hitachi, Ltd., Tokyo (JP)

( * ) Notice: Subject to any disclaimer, the term of this patent is extended or adjusted under 35 U.S.C. 154(b) by 964 days.

(21) Appl. No.: 12/298,382

(22) PCT Filed: Jun. 30, 2006

(86) PCT No.: PCT/JP2006/313148

§ 371 (c)(1),
(2), (4) Date: Oct. 24, 2008

(87) PCT Pub. No.: WO2008/001470

PCT Pub. Date: Jan. 3, 2008

(65) Prior Publication Data

US 2009/0085839 A1 Apr. 2, 2009

(51) Int. Cl.
*G09G 3/28* (2006.01)

(52) U.S. Cl. ..... 345/60

(58) Field of Classification Search ..... 345/60
See application file for complete search history.

(56) References Cited

U.S. PATENT DOCUMENTS

| | | | | |
|---|---|---|---|---|
| 6,670,774 | B2 * | 12/2003 | Son et al. | 315/169.4 |
| 2005/0083255 | A1 | 4/2005 | Son | |
| 2005/0162344 | A1 * | 7/2005 | Kang et al. | 345/60 |
| 2005/0212723 | A1 * | 9/2005 | Chung et al. | 345/60 |
| 2005/0212725 | A1 * | 9/2005 | Sasaki et al. | 345/63 |
| 2006/0152446 | A1 * | 7/2006 | Yamashita | 345/67 |
| 2006/0208964 | A1 * | 9/2006 | Ahn et al. | 345/60 |
| 2006/0232508 | A1 * | 10/2006 | Furukawa et al. | 345/60 |

FOREIGN PATENT DOCUMENTS

| | | | |
|---|---|---|---|
| JP | 10-222123 | | 8/1998 |
| JP | 2000-221940 | | 8/2000 |
| JP | 2005-122120 | | 5/2005 |
| JP | 2005123957 | * | 5/2005 |
| JP | 2005-148746 | | 6/2005 |
| JP | 2005-221812 | | 8/2005 |
| JP | 2005215132 | * | 8/2005 |
| JP | 2005221812 | * | 8/2005 |
| JP | 2005-326611 | | 11/2005 |
| JP | 2006-084623 | | 3/2006 |
| WO | WO2006112233 | * | 10/2006 |
| WO | WO2006112345 | * | 10/2006 |
| WO | WO2006112346 | * | 10/2006 |
| WO | WO2006132334 | * | 12/2006 |

* cited by examiner

*Primary Examiner* — Chanh Nguyen
*Assistant Examiner* — Robert Stone
(74) *Attorney, Agent, or Firm* — McDermott Will & Emery LLP

(57) ABSTRACT

This invention is directed to a technique capable of achieving image quality improvement by the control of reset thinning drive (second drive) in a PDP drive control and of restricting or reducing the generation of hunting in ON/OFF control of the second drive and flickering of background luminance particularly in the case of low-luminance display. In this PDP apparatus, in addition to the control of the second drive using the SF load ratio, the APL value (k) and APL variation value (q) of the field are used, and when the APL variation value (q) is less than a predetermined threshold value, even when the SF load ratio is changed from zero to a value other than zero between SFs, the execution of the first drive is not started, and the execution of the second drive is continued.

14 Claims, 11 Drawing Sheets

*FIG. 6*

| | FIELD | #1 | #2 | #3 | #4 | #5 | #6 | #7 | #8 | #9 | #10 |
|---|---|---|---|---|---|---|---|---|---|---|---|
| (a) SF | | | | | | | | | | | |
| (b) SF CLASSIFICATION | | LOW-LUMINANCE SF | | | | | HIGH-LUMINANCE SF | | | | |
| (c) CONTROL TARGET SETTING (1) | | 0 | 0 | 0 | 0 | 0 | 1 | 1 | 1 | 1 | 1 |
| (d) CONTROL TARGET SETTING (2) | | 1 | 1 | 1 | 1 | 1 | 1 | 1 | 1 | 1 | 1 |
| (e) SF LOAD RATIO (j) | | – | – | – | – | – | ≠0 | ≠0 | 0 | 0 | 0 |
| (f) SECOND DRIVE ON/OFF | | OFF | OFF | OFF | OFF | OFF | OFF | OFF | ON | ON | ON |
| (g) SF-Ron/Roff | | ○ | ○ | ○ | ○ | ○ | ○ | ○ | × | × | × |
| (h) m SETTING | | m#g1 | | | | | m#6 | m#7 | m#8 | m#9 | m#10 |
| (i) L SETTING | | L#g1 | | | | | L#6 | L#7 | L#8 | L#9 | L#10 |
| (j) a SETTING | | a#g1 | | | | | a#6 | a#7 | a#8 | a#9 | a#10 |

q : APL VARIATION VALUE
m : THRESHOLD VALUE

PLASMA DISPLAY APPARATUS WITH DRIVING AND CONTROLLING CIRCUIT UNIT

RELATED APPLICATIONS

This application is the U.S. National Phase under 35 U.S.C. §371 of International Application No. PCT/JP2006/313148, filed on Jun. 30, 2006, the disclosure of which Application is incorporated by reference herein.

TECHNICAL FIELD

The present invention relates to techniques for a drive method of a plasma display panel (PDP) and a display apparatus thereof (plasma display apparatus: PDP apparatus), and more particularly relates to an operation of a reset (initializing) period and a controlling method thereof in the drive control of the display region and period of the PDP.

BACKGROUND ART

As conventional PDP drive control of a PDP apparatus, in the operation of a reset period of a sub field (abbreviated as SF) of a field (field period), waveforms (reset pulses) for writing and adjusting charges for the cells are applied to display electrodes, thereby generating minute discharges (reset discharges) in the cells. By this means, the generation of discharges (address discharges) in selected cells in a next address period is ensured. In the basic drive control (normal drive: referred to as first drive), reset pulses are applied without thinning in the operation of the reset period of a SF.

As a PDP drive method, based on the above-described first drive, the following reset thinning drive (referred to as second drive) exists conventionally. In the second drive, application of the reset pulses is thinned in the operation of the reset period of a high-luminance SF that satisfies predetermined conditions, thereby realizing high-contrast control. In the second drive, in accordance with the load ratio of display in units of SF (SF load ratio or SF display ratio), reset operations are thinned out from the high-luminance SF side when the SF load ratio is zero. Also, when the SF load ratio is not zero, thinning of the reset operations of the SF is not carried out (first drive is employed). As described above, by virtue of the control of the second drive, in other words, by the control of the switching between the first drive and the second drive, the background luminance is reduced in correspondence with the amount of reduction in generation of the reset discharges by the reset thinning in the second drive, and the high-contrast display is achieved.

The SF load ratio is the ratio of the cells which are lit (on) with respect to all the cells of a SF. The SF load ratio is zero when there is no cell to be lit in the SF. The SF load ratio is not zero when there are cells to be lit in the SF. Also, the above-described high-luminance SF is one or more SFs in which weighting for luminance in a field is high. The SF in which the control of the second drive is to be employed (SF in which reset thinning can be selectively executed) is one or more continuous high-luminance SFs in accordance with the arrangement of SFs in a field.

Hereinafter, the state where the second drive is executed or effective is referred to as "ON" or the like. The state where the second drive is not executed or ineffective, in other words, the state where the first drive is executed is referred to as "OFF" or the like. Also, since the "ON" state corresponds to the state where the reset pulse is not applied, it is also expressed as "Roff" (reset off). Since the "OFF" state corresponds to the state where the reset pulse is applied, it is also expressed as "Ron" (reset on). Further, the operation (execution) of transition/switching of the drive state in the control of the second drive from "OFF" to "ON" is expressed as, for example, "OFF→ON", and the operation (cancel) of transition/switching from "ON" to "OFF" is expressed as, for example, "ON→OFF".

DISCLOSURE OF THE INVENTION

Problem to be Solved by the Invention

The above-described conventional control of the second drive has following problems. When the state is to be changed from the first drive to the second drive between SFs, in other words, when the second drive is to be executed (OFF→ON), the condition for the control determination (ON condition) is, for example, an instantaneous condition or a several-SF continuous condition related to the determination of the SF load ratio in the SFs. Meanwhile, when the state is to be reversely changed from the second drive to the first drive, in other words, the second drive is to be cancelled (ON→OFF), the condition for the control determination (OFF conditions) is, unlike the above-described ON condition, only the instantaneous condition related to the determination of the SF load ratio in the SFs.

The above-mentioned instantaneous condition related to the determination of the SF load ratio in the SFs and the control operation thereof mean that, for example, when, in the state where the SF load ratio is not zero and the second drive is OFF in a certain first SF, the SF load ratio becomes zero in a subsequent second SF, the second drive is instantaneously switched to ON from the second SF. Similarly, the above-mentioned several-SF continuous condition and the control operation thereof mean that, when the SF load ratio is zero in several continuous SFs including the SF, the second drive is switched from OFF to ON.

In the above-described control, particularly in the case of an image display such as the low-luminance display in which the APL (average luminance level) is gently varied and zero and values other than zero are repeated as the SF load ratio of high-luminance SFs, hunting (disturbance) in ON/OFF control of the second drive occurs, in other words, the phenomenon that the switching of ON/OFF of the second drive is repeated in a comparatively short period occurs. As a result, there is a problem that minute variations of the background luminance (flickering of background luminance) due to the number of times of reset discharges occur, and these are visually confirmed as image quality deterioration. As the case of the image display mentioned above, in an extreme case, small white spots blink on a full-black background.

In addition, as a general problem in the case where the conventional second drive is carried out, since reset stabilization is disturbed due to the reset thinning and tolerance against the environmental temperature and temporal change is deteriorated, there is the possibility that addressing misses occur and erroneous displays are caused.

The present invention has been made in view of the foregoing problems, and an object thereof is to provide techniques capable of obtaining high image quality by the control of reset thinning drive (second drive) in the PDP drive control and capable of restricting or reducing the generation of hunting in ON/OFF control of the second drive and flickering of background luminance particularly in the case of low-luminance display.

Means for Solving the Problems

The typical ones of the inventions disclosed in this application will be briefly described as follows. In order to achieve the above-described object, the present invention provides a technique for a PDP apparatus having a PDP and a circuit unit for performing the drive and control of the PDP, and it is characterized by having the following technical means.

The PDP apparatus of the present invention comprises means which controls reset thinning drive (second drive), in other words, controls switching between the first drive and the second drive by calculating or detecting the SF load ratio (j) and APL information based on picture (original image) signals and conversion data thereof (field and SF data) and combining an APL value (k) and a variation thereof (APL variation value: q) in addition to the information of the SF load ratio (j) used conventionally. In control conditions of the second drive, the APL value (k) and the APL variation value (q) are combined in addition to the SF load ratio (j), and the control is carried out in accordance with the determination result of the comparison between the APL information (k, q) and a threshold value so that variation of the switching of ON/OFF of the second drive becomes gentler than the conventional one (control by only the determination of the SF load ratio). By this means, occurrence of hunting of ON/OFF control of the second drive is addressed (reduced) particularly in the low-luminance display.

The APL value (k) is the value obtained by quantifying the brightness of the screen of the field period (f) of a certain cycle by the screen average. Also, an average APL value (p) is an average value of the APL value (k) in a plurality of fields. The average APL value (p) is, for example, a variable value obtained by summing (integrating) the APL values (k) in a period of n fields (n×f) and averaging the value by the number of the fields (n). Further, the APL variation value (q) is a value obtained by calculating the variation of the APL value (k) in a predetermined period by a predetermined format. The APL variation value (q) is calculated by, for example, the variation (Δp) of the average APL value (p) in the period of the n fields (n×f) which is a period of a predetermined cycle. Momentary APL variations are excluded from the control targets by using the temporal average.

The followings are typical examples of the configuration of application of the APL information (k, q, etc.) and the method of controlling the second drive in the present PDP apparatus and PDP drive method.

(1) The first is the control in the switching from the second drive to the first drive (second drive ON→OFF). As control condition determination, when the APL variation value (q) is less than a predetermined threshold value, for example, when the average APL variation (Δp) in the period of n fields is less than a first threshold value m1 ($0<m1<1$) ($q<m1$), even when the SF load ratio (j) in a high-luminance SF is changed from zero ($j=0$) to a value other than zero ($j\neq0$) between adjacent SFs, the execution (ON) state of the second drive of the SF is maintained without canceling (ON→OFF) the second drive.

(2) The second is the control in the switching from the first drive to the second drive (second drive OFF→ON). As control condition determination, when the APL variation value (q) is less than a predetermined threshold value, for example, when the average APL variation (Δp) in the period of n fields is less than a second threshold value m2 ($0<m2<1$) ($q<m2$), even when the SF load ratio (j) in a high-luminance SF is changed from a value other than zero ($j\neq0$) to zero ($j=0$) between adjacent SFs, the non-execution state (OFF) of the second drive, that is, the first drive is maintained without executing (OFF→ON) the second drive of the SF.

(3) Furthermore, the following control is provided in addition because the condition and state where the driving states (ON/OFF) are kept unchanged for a long period or infinitely can be established in both the above-described two controls (1) and (2). In addition to the control condition determination using the above-described threshold values m (m1, m2), control condition determination based on a threshold value of temporal limit (time limit value: L) or a limit value instead of a temporal value (threshold limit value: a) is provided. Consequently, with respect to the switching between the first and second drives, the execution state or the non-execution state of the second drive (ON/OFF) can be returned to the opposite side at an appropriate position of the SF so that the drive state is not kept unchanged for a long time or infinitely.

For example, the PDP apparatus according to the present invention has the following configuration. The PDP display apparatus comprises: a PDP which has a display region formed by a group of cells including a group of electrodes (sustain electrode, scan electrode, address electrode); and a circuit unit for driving and controlling the group of electrodes of the PDP, wherein, in drive control of a field period corresponding to the display region of the PDP, the field period has a plurality of SFs divided in accordance with weighting of luminance for grayscale expression, and the SF has periods and operations of reset, address, and sustain, and as basic control, when a load ratio which is a ratio of lighting cells of the SF is other than zero, drive in which the period and operation of the reset of the SF are not thinned is carried out as first drive, and when the load ratio is zero, drive in which at least a part of the period and operation of the reset of the SF is thinned is carried out as second drive. Also, in this PDP apparatus, based on display data, an APL value (k) of each field period is detected or calculated, and an APL variation value (q) which is a variation of the APL value (k) in a certain period including the field period is further calculated, and when the APL variation value (q) is less than a predetermined threshold value, even when the load ratio is changed from zero to a value other than zero between continuous SFs in the field period, execution of the second drive is continued without starting execution of the first drive by giving higher priority than the basic control.

With respect to general problems of the case where the second drive is carried out, in the controlling method in the present PDP apparatus, comparatively minute APL variations are taken into consideration as objects in the case of image display, and the control in which ON/OFF of the second drive is varied more flexibly than conventional cases is carried out by using the APL information. Therefore, even when hunting of ON/OFF occurs, it can be limited to the degree that does not cause actual damages (that is, image quality deterioration is not sensed).

Effect of the Invention

The effects obtained by typical aspects of the present invention will be briefly described below. According to the present invention, image quality improvement can be achieved by the control of the reset thinning drive (second drive) in PDP drive control, and occurrence of hunting of the ON/OFF control of the second drive and flickering of the background luminance particularly in the case of low-luminance display can be restricted or reduced.

BRIEF DESCRIPTION OF THE DRAWINGS

FIG. 6 is a drawing showing a basic example, a setting example and others of switching control between the first drive and the second drive in the PDP apparatus according to the embodiment of the present invention;

BEST MODE FOR CARRYING OUT THE INVENTION

Figure 12:
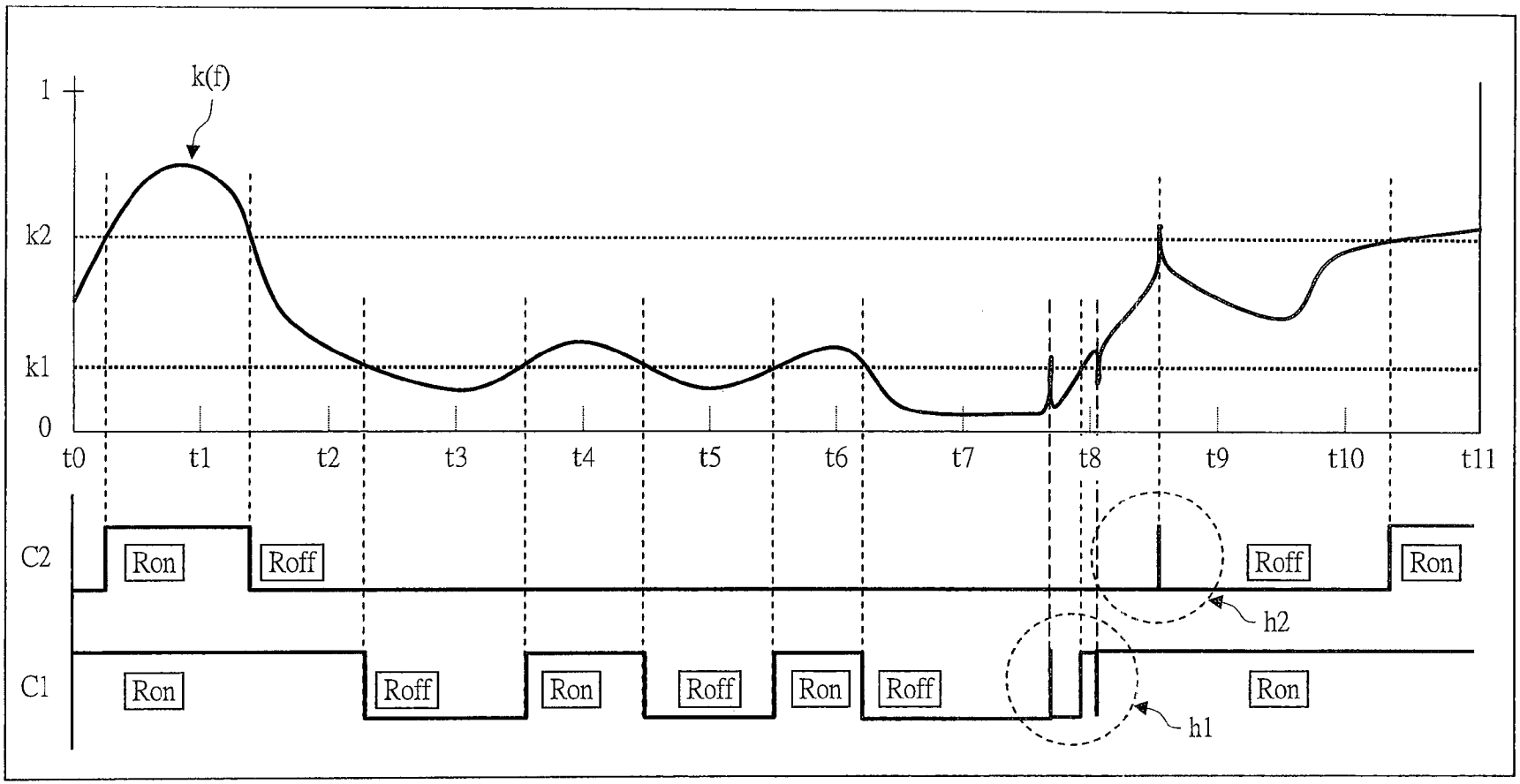
FIG. 12 is a drawing showing an example of a switching control between the first and second drives in a PDP apparatus according to a presupposed technique of the present invention.

Hereinafter, embodiments of the present invention will be described in detail with reference to the accompanying drawings. Note that components having the same function are denoted by the same reference numbers throughout the drawings for describing the embodiments, and the repetitive description thereof will be omitted. FIG. 12 shows an example of control of second drive according to a presupposed technique of the present invention for facilitating the understanding of the present invention through the comparison with the present invention.

First Embodiment

A first embodiment of the present invention will be described with reference to FIG. 1 to FIG. 9. The first embodiment is characterized in that, in the switching control between normal drive (first drive) and reset thinning drive (second drive), an inspection of first control conditions relating to an APL variation value (q) is carried out in addition to zero-determination of the SF load ratio (j), and based on the results thereof, the ON/OFF of the control of the second drive is switched so that they are flexibly varied.

<PDP Apparatus>

Figure 1:
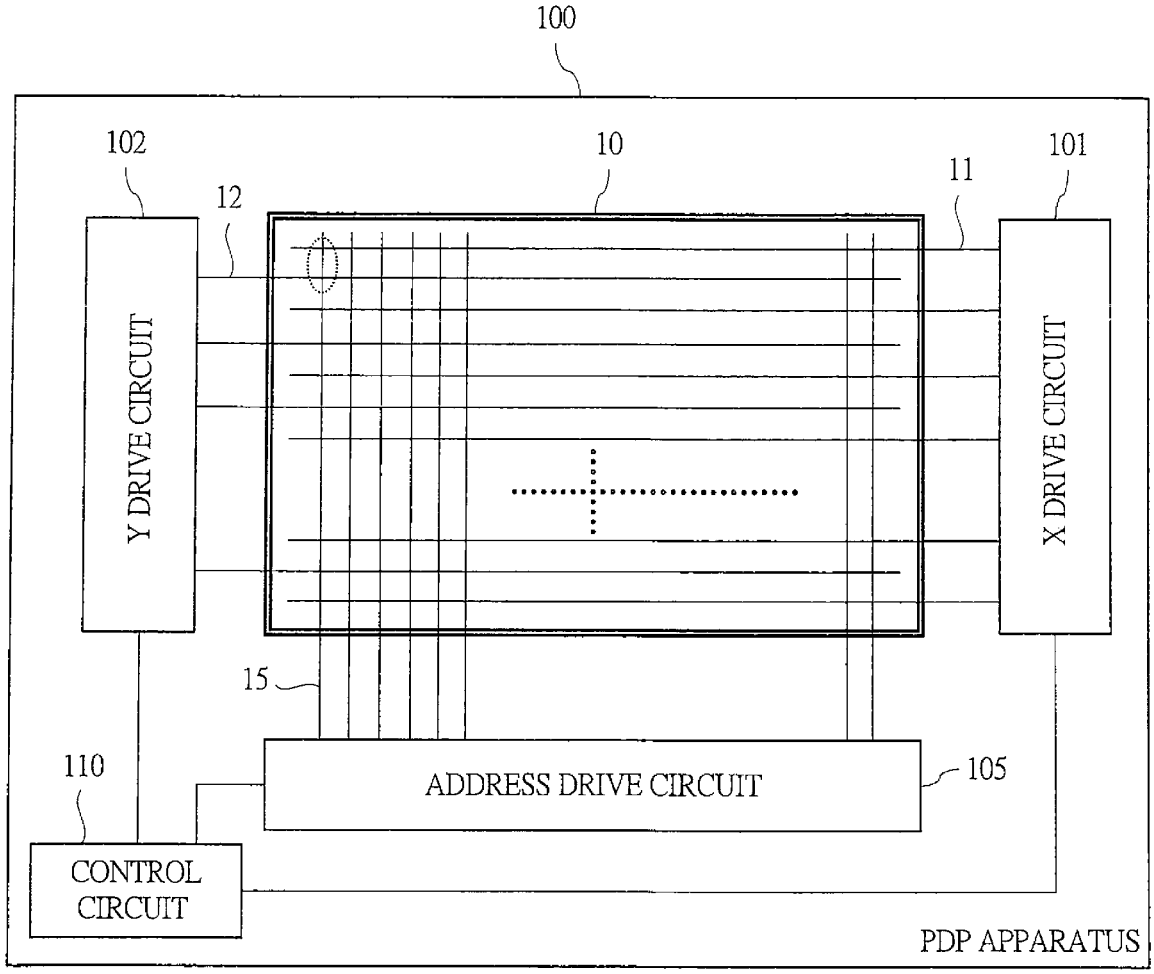
FIG. 1 is a drawing showing the entire configuration of a PDP apparatus according to an embodiment of the present invention.

First, the entire configuration of a PDP apparatus (PDP module) 100 according to the present embodiment will be described with reference to FIG. 1. The PDP apparatus 100 is configured to have a PDP (display panel) 10 and a circuit unit for drive and control thereof. In the PDP module, the PDP 10 is attached to and retained by a chassis unit (not shown), the circuit unit is comprised of ICs and others, and the PDP 10 and the circuit unit are electrically connected to each other. Furthermore, the PDP module is housed in an external chassis, thereby forming the PDP apparatus (product set).

Sustain electrodes (X electrodes) 11, scan electrodes (Y electrodes) 12, and address electrodes (A electrodes) 15 of the PDP 10 are connected to corresponding drive circuits (drivers), that is, an X (sustain) drive circuit 101, a Y (scan) drive circuit 102, and an address drive circuit 105, respectively, and are driven by voltage waveforms of corresponding drive signals. The drivers (101, 102, 105) are connected to a control circuit 110 and controlled by control signals. The control circuit 110 controls the entirety of the PDP apparatus 100 including the drivers, and it generates the control signals, display data (SF data) and others for driving the PDP 10 based on input display data (picture signals) and outputs them to the drivers. Also, a power supply circuit (not shown) supplies power to respective circuits such as the control circuit 110 and others.

Note that the configuration of the circuit unit is changed in accordance with the drive method. For example, in a possible configuration, address drive circuits 105 are connected and disposed on the upper and lower sides of the PDP 10 in accordance with the division of the address electrodes 15 of the display region of the PDP 10, and the divided groups of the address electrodes 15 can be individually driven from the upper and lower address drive circuits 105.

<PDP>

Figure 2:
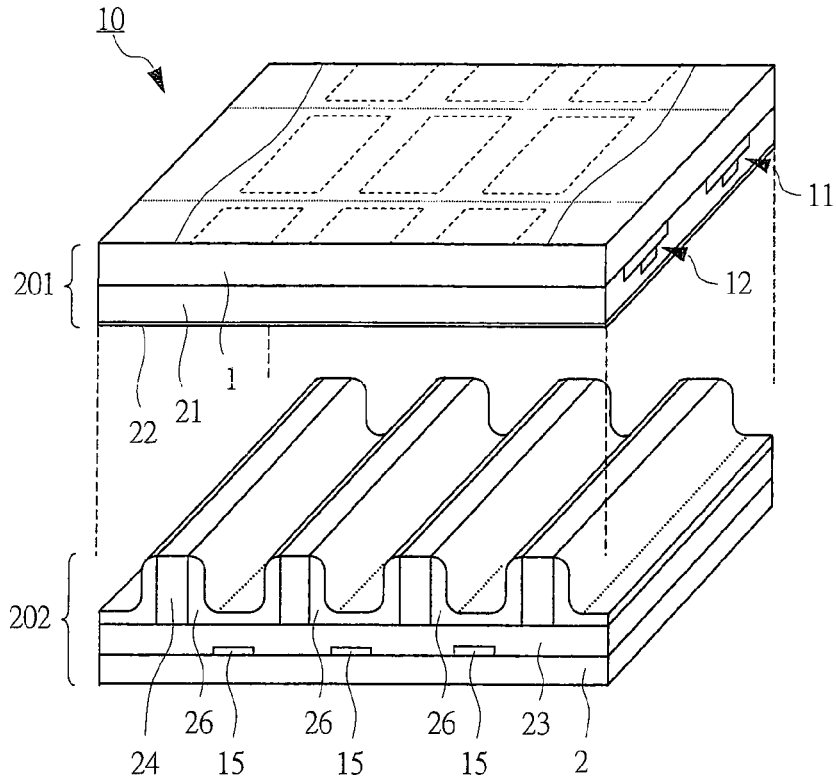
FIG. 2 is a drawing showing the structure of a PDP in the PDP apparatus according to the embodiment of the present invention.

Next, an example of a structure of the PDP 10 (AC type, surface discharge, (X, Y, A) three electrodes, X-Y alternating arrangement, and stripe rib configuration) will be described with reference to FIG. 2. The PDP 10 is configured by combining a front surface unit 201 on the side of a front surface substrate 1 made of glass and a rear surface unit 202 on the side of a rear surface substrate 2.

In the front surface unit 201, on the front surface substrate 1, a plurality of sustain electrodes (X) 11 and scan electrodes (Y) 12 which are electrodes (display electrodes) for carrying out repeated discharges of display extend in parallel in a first direction (lateral direction) with a predetermined interval and are alternately disposed repeatedly in a second direction (longitudinal direction). These display electrode groups (11, 12) are covered with a first dielectric layer 21, and the surface of the first dielectric layer 21 facing discharge spaces is covered with a protective layer 22 made of, for example, MgO. Each of the display electrodes (11, 12) is comprised of, for example, a linear bus electrode made of metal and a transparent electrode electrically connected to the bus electrode and forming a discharge gap with an adjacent electrode.

In the rear surface unit 202, on the rear surface substrate 2, a plurality of address electrodes 15 are disposed to extend in parallel in a second direction that is approximately orthogonal to the display electrodes (11, 12). Furthermore, the group of the address electrodes 15 is covered with a second dielectric layer 23. Barrier ribs (vertical ribs) 24 extending in the second direction are disposed on both sides of each address electrode 15, and they partition the cells in the column direction of the display region. Furthermore, phosphors 26 of corresponding colors which emit visible light of red (R), green (G), and blue (B) when excited by ultraviolet rays are applied for each of the columns on the upper surface of the second dielectric layer 23 on the address electrodes 15 and on side surfaces of the barrier ribs 24.

By bonding the front surface unit 201 on the side of the front surface substrate 1 and the rear surface unit 202 on the side of the rear surface substrate 2 to each other so that the protective layer 22 and the upper surface portions of the barrier ribs 24 are in contact with each other, and sealing a discharge gas of, for example, Ne—Xe in the discharge space, the PDP 10 is configured.

This is the configuration (so-called ALIS configuration) in which the display electrodes (11, 12) are paired with the display electrodes of the other type which are adjacent on both the upper and lower sides in the second direction so as to form the rows of (X, Y), cells are formed so as to correspond to the regions intersecting with the address electrodes 15 and partitioned by the barrier ribs 24, and discharges are carried out in the discharge gaps of the cells. A pixel is formed by a set of the cells of R, G, and B.

The PDP 10 can employ various configurations other than the above-described example in accordance with the drive method, and characteristics of the present invention and embodiments can be applied also to these various configurations. Another configuration example of the PDP is, for example, a box-like rib configuration in which lateral ribs which partition the cells in the column direction are provided in addition to the vertical ribs. Further, there is also a normal configuration in which the display electrodes are paired with the display electrodes of the other type which are adjacent on one side in the second direction so as to form the rows. Furthermore, there is a configuration in which the display electrodes of the same type are disposed to be adjacent to each other on the side of the slit where discharge does not occur.

<Field>

Figure 3:
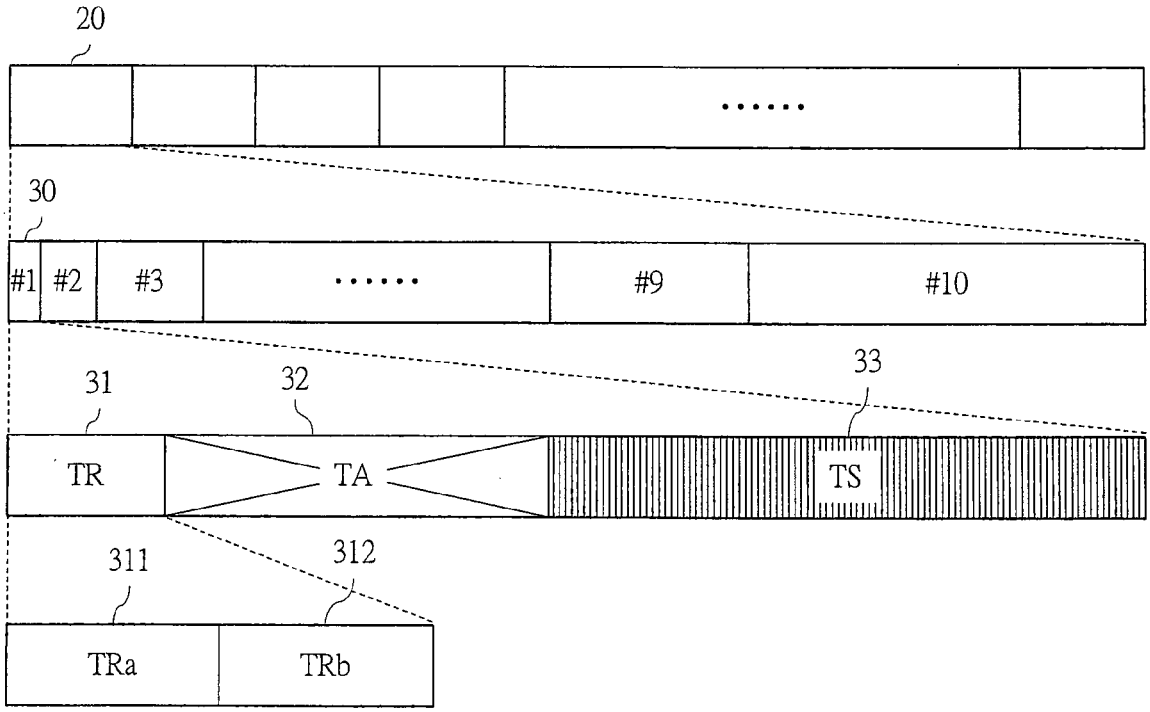
FIG. 3 is a drawing showing the configuration of fields in the PDP apparatus according to the embodiment of the present invention.

Next, as a drive control method of the PDP 10, the configuration in the display unit of an image (referred to as a field or frame) corresponding to the display region (screen) of the PDP 10 will be described with reference to FIG. 3. One field (field period) 20 constituting the image is displayed in 1/60 second. One field 20 includes a plurality of SFs (also called subframes) 30 divided in terms of time for grayscale display. In the present example, one field 20 includes ten SFs 30 of first SF "#1" to tenth SF "#10". Each SF 30 includes a reset period (TR) 31, a subsequent address period (TA) 32, and a subsequent sustain period (TS) 33. Each of the SFs 30 of the field 20 is weighted by the length of the TS 33 (the number of times of sustain discharges), and grayscales are expressed by the combination of lighting on/off of each SF 30. The drive method of the present example is an example of the general "address/display separation method" (ADS). More specifically, this is the method in which the cell group in the SF 30 is addressed in the TA 32 and displaying is carried out in the next TS 33.

As an outline of the drive, in the TR 31, an operation (reset operation) of writing (accumulation) and adjusting charges for the preparation for the operation of the next TA 32 is carried out for the group of the cells of the SF 30. In the TA 32, an operation (address operation) of selecting the cells to be lit (on)/unlit (off) from the group of the cells of the SF 30 is carried out. In the TS 33, an operation (sustain operation) of generating repeated discharges (sustain discharge) for displaying the cells selected in the SF 30 is carried out.

First, in the TR 31, the charges of the cells of the SF 30 formed in an immediately preceding TS 33 are erased, and in order to support and prepare the discharges (address discharges) in the subsequent TA 32, the charges of the cells are reallocated and adjusted by, for example, applying reset pulses to the display electrodes (11, 12). Furthermore, the TR 31 includes, for example, a first period (TRa) 311 and a second period (TRb) 312, and as the reset pulses, charge writing pulses are applied in the first period 311 and charge adjusting pulses are applied in the second period 312. In this manner, minute discharges (reset discharges) are generated in the cells, thereby ensuring the occurrence of address discharges in the next TA 32.

In the next TA 32, discharges (address discharges) of selecting the cells to be lit among the group of the cells of the SF 30 are carried out. In the TA 32, scan pulses are applied to the target scan electrodes 12, and address pulses are applied to the selected address electrodes 15, thereby generating the address discharges in the cells to be lit. As the scanning operation in the SF 30, for example, addressing of the first line (row) of the scanning electrode 12 is first carried out, scanning is sequentially carried out for the second and third lines, and then addressing is carried out up to the last line. The influence of the light emission of the reset discharges exerted on the luminance is small compared with the light emission of the address discharges.

In the next TS 33, sustain discharge pulses are applied between all the display electrodes (11, 12) (X-Y), thereby generating the sustain discharges in the cells selected in the immediately preceding TA 32 and causing the cells to emit light (lighting).

Note that the addressing methods include a method of forming charges in the cells to be lit (writing addressing method) and a method of erasing the charges in the cells not to be lit (erasing addressing method), and either one of them can be applied. In the present example, the former method is employed. Various configurations are applicable in details such as the division of the above-described periods.

<Voltage Waveforms of First Drive>

Next, an example of voltage waveforms of drive signals of the PDP 10 in the case of the first drive will be described with reference to FIG. 4. Voltage waveforms (Vx, Vy, Va) applied to the sustain electrode (X) 11, the scan electrode (Y) 12, and the address electrode (A) 15 in the TR 31 to the TS 33 of the SF 30 are shown in (a), (b) and (c) of FIG. 4, respectively. As an example, the voltage waveforms of a first SF 30-1 (for example, SF #1) and a second SF 30-2 (for example, SF #2) subsequent thereto in the field 20 are shown here. The TR 31 includes the first period 311 and the second period 312 described above. Note that, in order to facilitate the understanding, the positions where various discharges occur between the electrodes are denoted by circles.

In the first SF 30-1, in the operation of the TR 31, reset discharges are generated by applying reset pulses by executing the first drive (second drive OFF). Also in the subsequent second SF 30-2, in the operation of the TR 31, reset discharges are generated by applying reset pulses by keeping the first drive, and the remaining charges of the immediately preceding SF 30 are erased.

First, in the TR 31, in (a) Vx and (b) Vy, charge writing pulses are applied to the display electrodes (11, 12) in the first period 311. More specifically, in (b) vy, a rising slope waveform 51 is applied to the scan electrodes (Y) 12 as a waveform for forming charges in all the cells of the SF 30. Further, in (a) Vx, an X voltage 41 having the reversed polarity is applied to the sustain electrodes (X) 11 as a waveform corresponding to Vy.

Subsequently, in the second period 312, charge adjustment pulses are applied to the display electrodes (11, 12). More specifically, in (b) Vy, a falling slope waveform 52 is applied to the scan electrodes (Y) 12 as a waveform for erasing the charges formed in the cells other than necessary amounts of the charges. Further, in (a) Vx, an X voltage 42 having the reversed polarity is applied to the sustain electrodes (X) 11 as a waveform corresponding to Vy.

By the application of the above-described reset pulses in the TR 31, weak reset discharges are generated between the display electrodes (11, 12) (X-Y).

In the next TA 32, in (a) Vx and (b) Vy, as waveforms for generating address discharges for determining the cells to be lit in the row direction, for example, a scan pulse 53 of an arbitrary N-th row and an X voltage 43 for forming a wall charge by this discharge are applied to the display electrodes (11, 12). The scan pulse 53 is sequentially applied respectively to the rows with shifted timings. At the same time, in (c) Va, in each of the cells to be lit, an address pulse 60 is applied to the address electrode 15 in accordance with the scan pulse 53. By this means, an address discharge is generated between the scan electrode (Y) 12 and the address electrode (A) 15 (Y-A), which develops to the formation of the wall charge between the scan electrode (Y) 12 and the corresponding sustain electrode (X) 11 (Y-X).

In the next TS 33, in (a) Vx and (b) Vy, sustain pulses (44, 45, 54, 55) are applied to the display electrodes (11, 12), and a sustain discharge is generated. For example, first, the first negative sustain pulse 44 of (a) Vx and the first positive sustain pulse 54 of (b) Vy are applied, subsequently, the second positive sustain pulse 45 of (a) Vx and the second negative sustain pulse 55 of (b) Vy are applied, and thereafter, repeated waveforms having alternately reversed polarities are similarly applied by the number of times corresponding to the weighting of the SF 30.

<Voltage Waveform of Second Drive>

Next, an example of the voltage waveforms of the drive signals of the PDP 10 in the case of the second drive will be described with reference to FIG. 5. FIG. 5 is different from FIG. 4 in the configuration of the TR 31 in the second SF 30-2. As an example, the voltage waveforms of the first SF 30-1 (for example, SF #1) in the field 20 and the second SF 30-2 (for example, SF #2) subsequent thereto are shown. In the case shown here, the operation of the TR 31 is not thinned in the first SF 30-1, and the operation of the TR 31 is partially thinned in the subsequent second SF 30-2 because the SF load ratio is zero. When the SF load ratio is zero in a certain SF, the cells are unlit (off), and therefore, either one of the execution and thinning can be selected for the reset operation immediately before the address operation, and when thinning is selected, the light emission by the reset discharges can be reduced.

In the first SF 30-1, in the operation of the TR 31, reset discharges are generated by applying reset pulses by executing the first drive (second drive OFF). Subsequently, in the second SF 30-2, in the operation of the TR 31, the reset pulses are thinned by executing the second drive (OFF→ON), and reset charges are not generated.

As the operation of the second SF 30-2, in the TR 31, the first period 311 and the application of the charge writing pulses thereof are omitted. Subsequently, in the second period 312, charge adjustment pulses are applied in the same manner as described above. Because of the above-described thinning of the reset pulses in the TR 31, the above-described weak reset discharges are not generated. The operations of the subsequent TA 32 and TS 33 are the same as those described above.

The case of the second drive in the continuous two SFs 30 has been described above. Similarly, in the case where the state where the SF load ratio is zero continues for a plurality of continuous SFs 30, the reset operations can be thinned by keeping the ON state of the second drive, and the drive time can be correspondingly shortened.

<Basics of Control>

Figure 4:
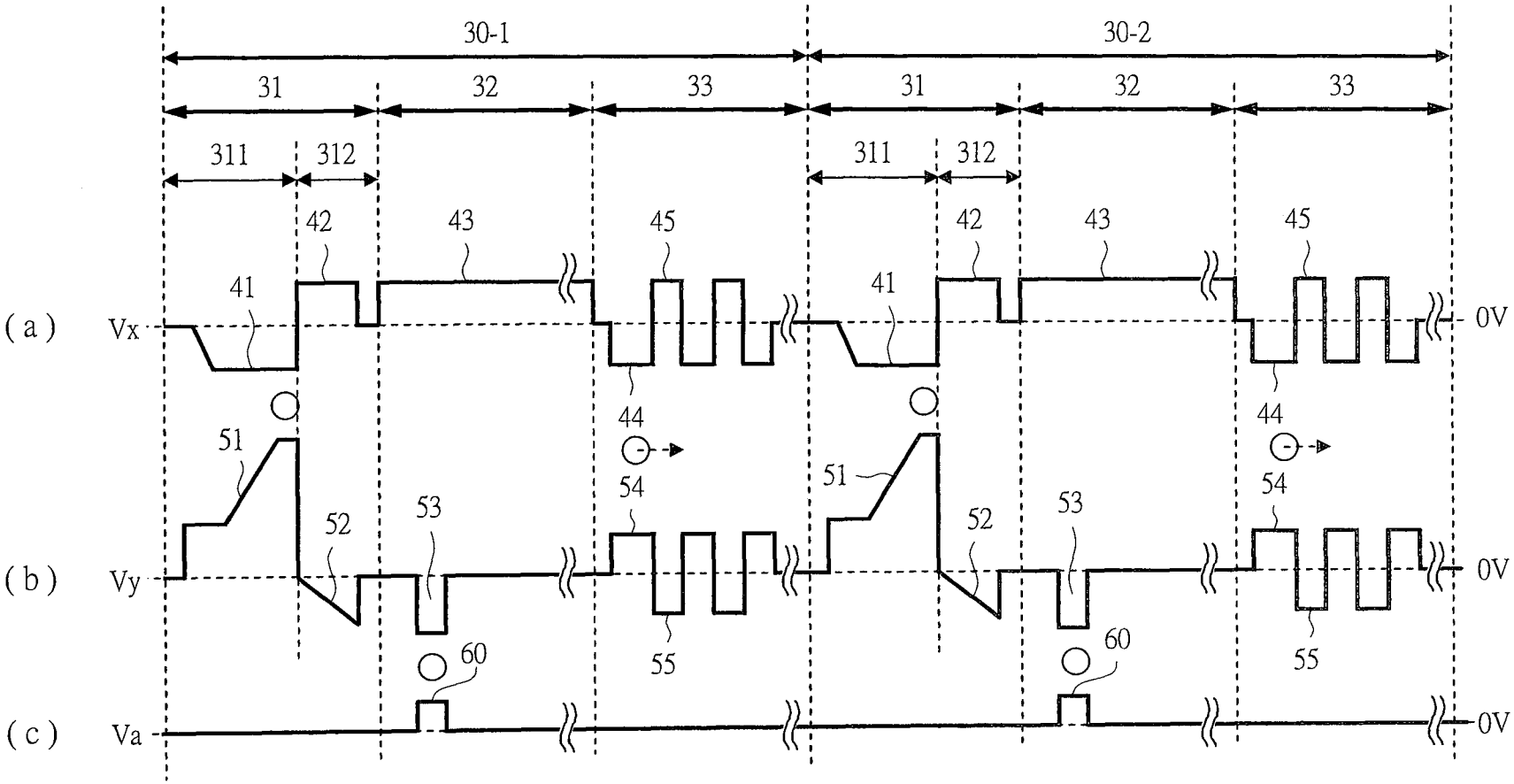
FIG. 4 is a drawing showing a configuration example of drive waveforms in first drive in the PDP apparatus according to the embodiment of the present invention.
Figure 5:
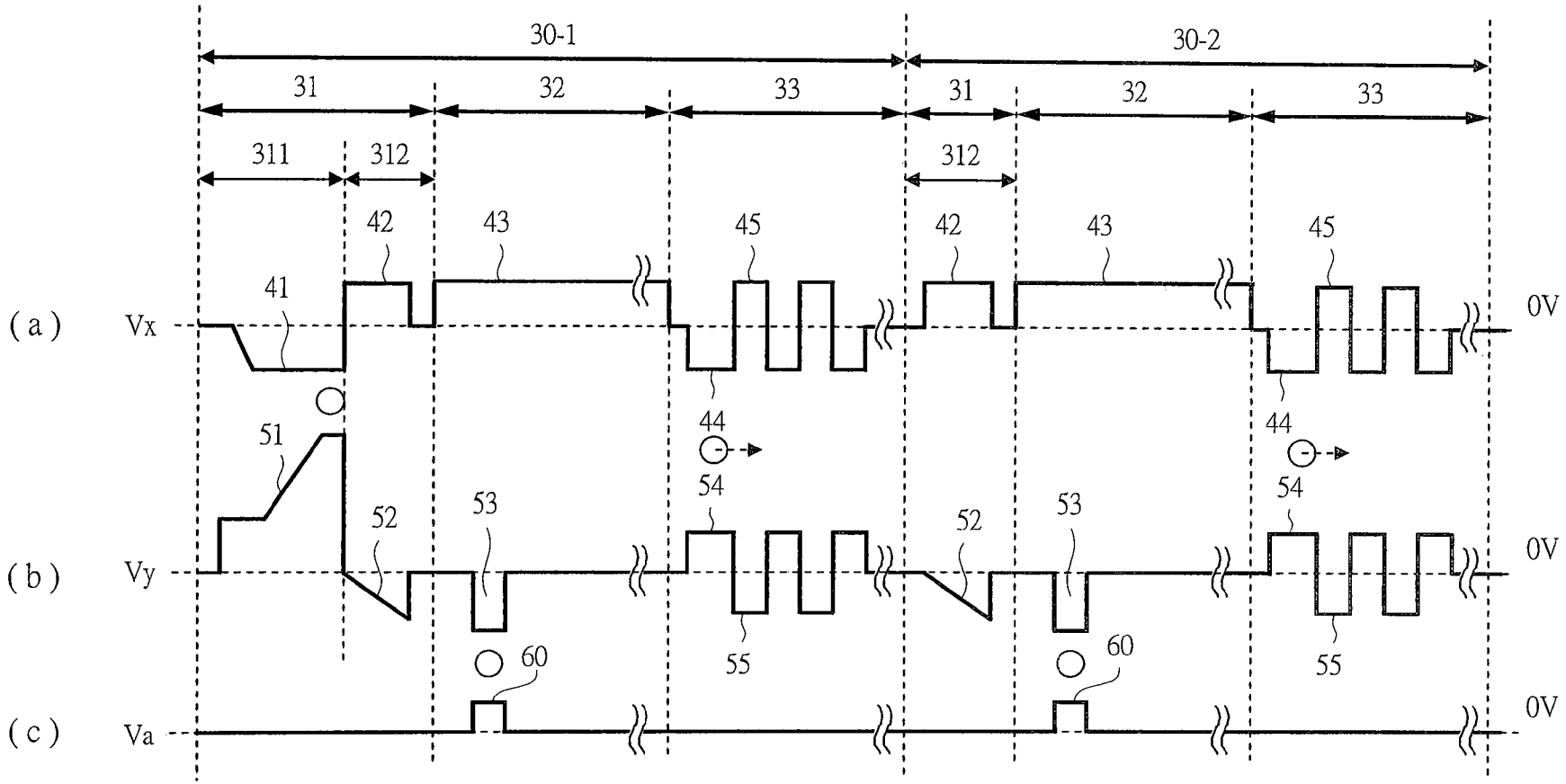
FIG. 5 is a drawing showing a configuration example of drive waveforms in second drive in the PDP apparatus according to the embodiment of the present invention.

Next, a basic example of the control of switching between the first drive as shown in FIG. 4 and the second drive as shown in FIG. 5 will be described with reference to FIG. 6. The field 20 having a constant cycle has, for example, ten SFs 30 (SF #1 to SF #10) as shown in (a). As shown in (b), in classification of the SFs 30, high-luminance SFs which are control targets of the second drive are, for example, five SFs 30 of "SF #6" to "SF #10". Also, low-luminance SFs are five SFs 30 other than those such as "SF #1" to "SF #5".

As shown in (e), the SF load ratio (j) is calculated for each of the SFs 30. The SFs 30 having j=0 are the targets to turn ON the second drive. For example, when j=0 in the three SFs 30 of "SF #8" to "SF #10", these SFs 30 are targets of "ON" of the second drive as shown in (f). In the SFs 30 in which the second drive is ON, as shown in (g), application of reset pulses is thinned (Roff: x marks). As the switching control between the first and second drives, the second drive is executed (OFF→ON) at the time of shift from the SF #7 to the SF #8.

In the five SFs 30 of "SF #1" to "SF #5" which are low-luminance SFs, for example, regardless of the SF load ratio (j), the first drive is always applied (second drive OFF), and reset pulse application is carried out (Ron: circle marks).

<Presupposed Techniques>

The configuration and problems of the control of the second drive in a PDP apparatus according to a presupposed technique of the present invention will be described with reference to FIG. 12. FIG. 12 shows the switching of OFF (Ron)/ON (Roff) of the second drive for high-luminance SFs under the condition that the SF load ratio (j) is zero in the control of the second drive. In the graph on the upper side, the horizontal axis represents time (t) corresponding to the field 20 and the SFs 30, the vertical axis represents the APL value (k), and the waveform of k(f) represents the APL value (k) varied along with transition of the field 20(*f*). A first threshold value (k1) and a second threshold value (k2) relating to the APL value (k) are shown so as to correspond to the threshold values used in the control of the present embodiment. Binary waveforms of C1 and C2 on the lower side correspond to the example of the variation of the APL value (k) on the upper side and represent the state of switching of ON (Roff)/OFF (Ron) of the second drive in terms of time corresponding to an example of the variation of the SF load ratio (j) (not shown). C1 represents, for example, a control signal with respect to the SF #6, and C2 represents a control signal with respect to the SF #7.

Examples of the positions where hunting occurs in ON/OFF of the control of the second drive are h1 and h2. Conventionally, since ON/OFF is switched only in accordance with the zero determination of the SF load ratio (j), ON and OFF are sometimes repeated in a short period due to the rapid variation of the APL value (k) relating to the SF load ratio (j) like in h1 and h2. This leads to the flickering of the background luminance described above. Note that, although the APL value (k) relates to the SF load ratio (j), they are not the same value. The case where the APL value (k) and the SF load ratio (j) are small and the SF load ratio (j) varies between zero and values other than zero may occur in the low-luminance display.

<Control Circuit>

Next, a detailed configuration example of the control circuit 110 in the PDP apparatus according to the present embodiment will be described with reference to FIG. 7. In the present embodiment, the control circuit 110 controls overall switching between the first and second drives.

The control circuit 110 includes a SF data conversion unit 111, an image memory 112, an address data transfer unit 113, a SF load ratio calculating unit 114, a SF load ratio determination unit 115, a drive waveform control unit 116, an APL information calculating unit 120, and inspection units (121, 122, 123). A PDP drive unit 130 (corresponding to the above-described drivers), a setting unit 140, and others are connected to the control circuit 110. As the characteristic parts of the present embodiment, the APL information calculating unit 120, the first control condition inspection unit 121, the second control condition inspection unit 122, the third control condition inspection unit 123, and the setting unit 130 are provided.

The SF data conversion unit 111 generates data (SF data) of the fields 20 and the SFs 30 through conversion based on input display data (picture signals) D. The image memory 112 stores the SF data, etc. The address data transfer unit 113 transfers the address data for the address operation of drive of the PDP 10 to the PDP drive unit 130 based on the SF data. As the input display data (D), for example, picture signals of (R, G, B) are input from external devices such as a TV tuner and a computer.

The drive waveform control unit 116 switches and outputs the control signals of the drive waveforms with respect to the PDP drive unit 130 in accordance with result information input from the SF load ratio determination unit 115 and the inspection units (121 to 123). In this example, in the drive waveform control unit 116, logical conditions are obtained from the result information, thereby finally switching the drive control of the corresponding types. The PDP drive unit 130 outputs drive waveforms to the PDP 10 so as to drive it in accordance with the control signals from the drive waveform control unit 116.

The SF load ratio calculating unit 114 calculates the SF load ratio (j) of each of the SFs 30 based on the picture signals and the SF data. The SF load ratio determination unit 115 is the part that carries out basic determination for the control of the second drive, and it outputs an instruction for switching the contents of the control to the drive waveform control unit 116 by determining the SF load ratio (j) of the SF 30.

The SF load ratio determination unit 115 determines whether the SF load ratio (j) of the SF 30 is zero or not as the control condition. As a basic policy, when the SF load ratio (j) in a high-luminance SF is other than zero ($j \neq 0$), the first drive is applied (ON) to the SF 30 instead of applying the second drive (OFF) thereto, and reset pulse application is carried out (Ron). Also, when the SF load ratio (j) in a high-luminance SF is zero ($j=0$), the second drive is applied (ON) to the SF 30, and reset pulse application is not carried out (Roff). In accordance with the determination, the SF load ratio determination unit 115 outputs an instruction (c1) of OFF (Ron) of the second drive or an instruction (c2) of ON (Roff) to the drive waveform control unit 116 as the result information.

The APL information calculating unit 120 calculates the APL value (k) of the fields 20 based on the picture signals and SF data, and further calculates the APL variation value (q) in the plural fields 20 based on the calculated APL value (k).

The first to third control condition inspection units (121, 122, 123) are the units that carry out the inspection (determination) of the control conditions using the APL information in addition to the basic control by the SF load ratio determination unit 115, and they switch the control contents in accordance with the inspections of the control conditions, in other words, output the instructions to the drive waveform control unit 116. The results of the determination in each inspection unit are output to the drive waveform control unit 116 as the result information.

The drive waveform control unit 116 simply carries out the determination by obtaining conditions of AND (logical multiplication) or OR (logical addition) in accordance with the input of the result information from the SF load ratio determination unit 115 and the first to third inspection units (121, 122, 123) and finally determines and executes the switching of the first and second drives. On the basis of the result of zero determination of the SF load ratio (j), the results of the determination of the first to third inspection units (121, 122, 123) are added (prioritized) thereto. In correspondence with the switching of the drive, the control information for outputting the drive waveforms as shown in FIG. 4 of the case where the first drive is ON or the drive waveforms as shown in FIG. 5 of the case where the second drive is ON is output to the PDP drive unit 130.

Figure 7:
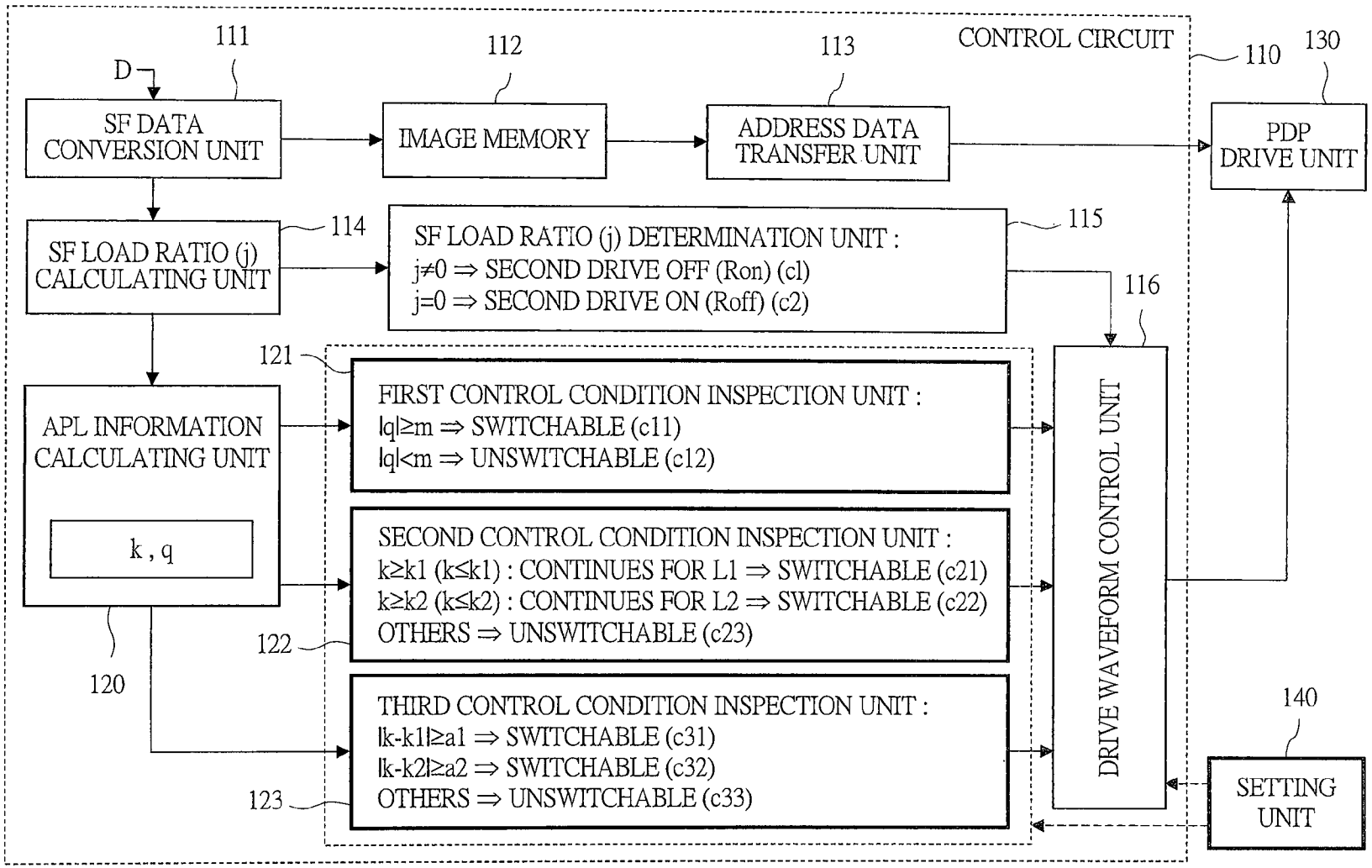
FIG. 7 is a drawing showing a detailed block configuration example of a control circuit in the PDP apparatus according to the embodiment of the present invention.

Note that, in the configuration of FIG. 7, the configuration having all of the functions of the first to third control condition inspections is shown. However, the configuration having a part of the functions can also be employed.

<APL Information>

Next, the APL information for use in the control will be described with reference to FIG. 8. The horizontal axis represents time (t) corresponding to the fields 20 (*f*) and the SFs 30, and the vertical axis represents the APL information. A triangle shows the concept of the APL variation value (q) and others. The APL variation value (q) is calculated as, for example, a variation ($\Delta p$) of an average APL value (p) in the period of n fields ($n \times f$).

Based on the APL value (k) of each field 20 (*f*), the average APL value (p) in the plurality of fields 20 is calculated. The average APL value (p) is the value obtained by summing up the APL values (k) in a period of a certain cycle having a plurality (n) of continuous fields 20 including the focused field 20 (period of n fields: $n \times f$) and averaging it by the number of the fields (n). For example, n is 60. Then, the variation of the average APL value (p) in the period of n fields ($n \times f$) is calculated as $\Delta p$. As the APL variation value (q), for example, $\Delta p/(n \times f)$ is used. The inclination of the triangle corresponds to the threshold value (m) relating to the APL variation value (q).

<First Control>

Figure 9:
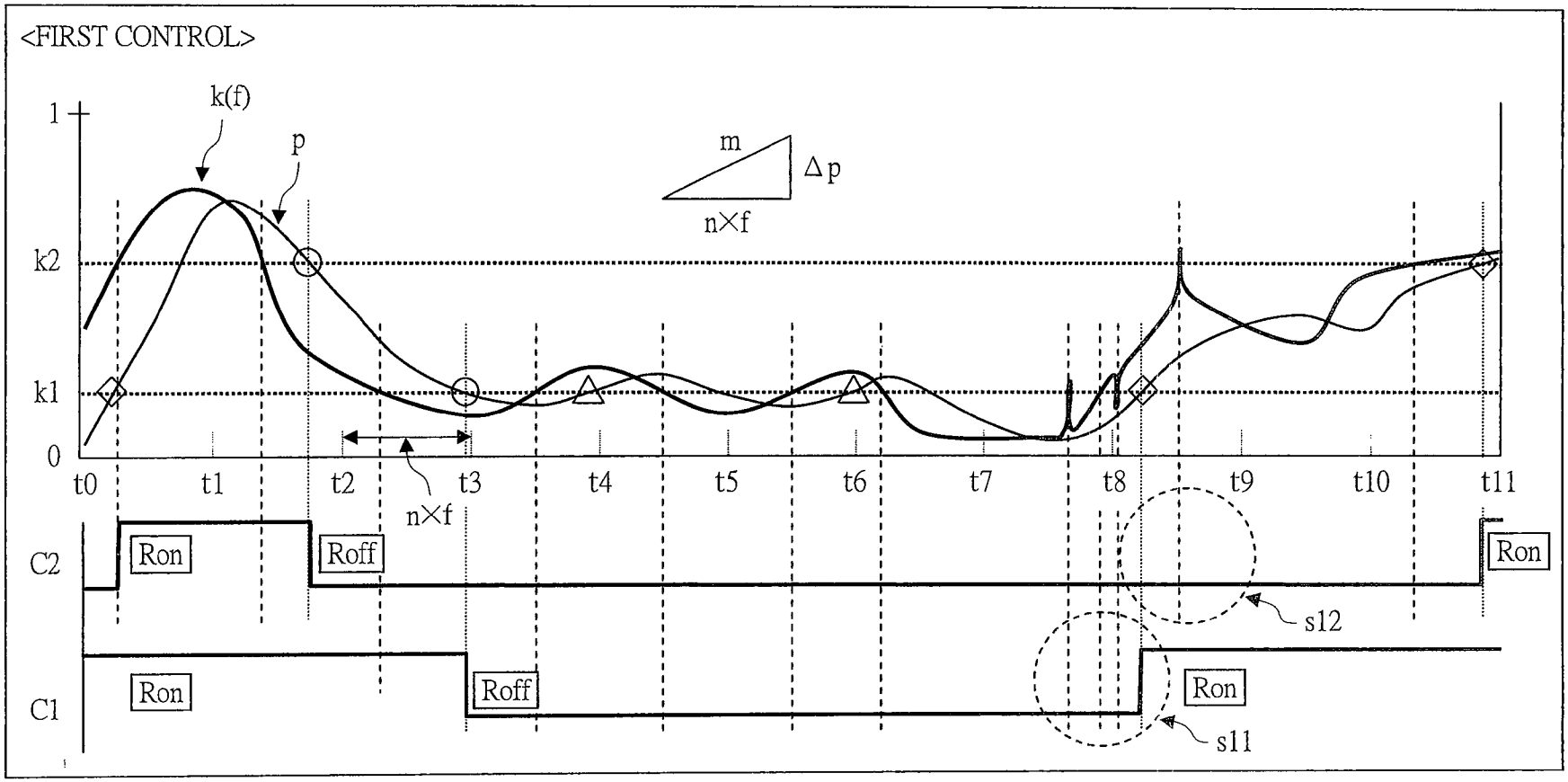
FIG. 9 is a drawing showing an example of the first control in a PDP apparatus according to a first embodiment of the present invention.

Next, the first control in the PDP apparatus according to the first embodiment will be described with reference to FIG. 9 and others. FIG. 9 shows an example of the APL information and ON/OFF control in the first control. In the graph on the upper side, with respect to the time (t) of the horizontal axis and the APL information of the vertical axis, k(f) represents a temporal transition of the APL value (k) corresponding to the field 20 (*f*). The average APL value (p) is an average value of the APL value (k) in the period of n fields ($n \times f$). C1 and C2 shows control logics for the two SFs 30 having different luminance, and APL threshold values respectively corresponding thereto are k1 and k2. k1 and k2 ($0<k1<k2<1$) are the threshold values about the APL variation value (q) which relates to the determination (inspection of the first control condition) of ON/OFF of the second drive in the first control. For example, k1 is a first threshold value corresponding to the control signal C1 which instructs the first and second drives with respect to the SF #6, and k2 is a second threshold value corresponding to the control signal C2 with respect to the SF #7.

The binary waveforms of C1 and C2 on the lower side correspond to the example of the variation of the APL information on the upper side and represent the state of switching of ON (Roff)/OFF (Ron) of the second drive in terms of time corresponding to an example of the variation of the SF load ratio (j) (not shown) and the APL information on the upper side.

Figure 8:
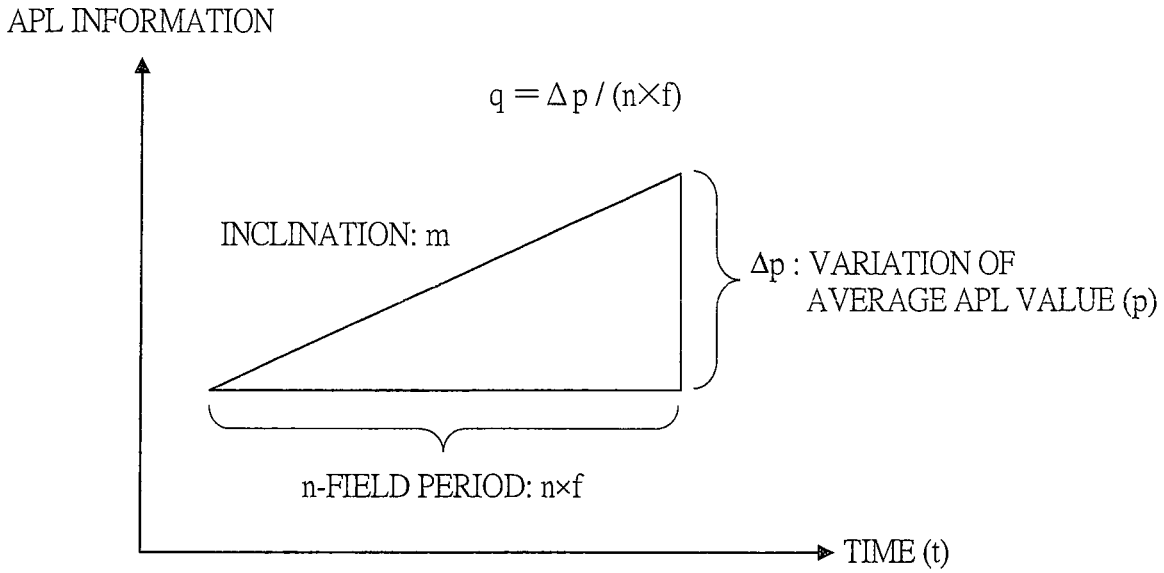
FIG. 8 is a drawing showing the concept of APL information in the PDP apparatus according to the embodiment of the present invention.

As the first control, in the first control condition inspection unit 121 of FIG. 7 described above, the variation (Δp) of the average APL value (p) as the APL variation value (q) is compared with the threshold value (m) as shown in FIG. 8 described above, switching of ON/OFF of the second drive is determined, and the result information (c11, c12) thereof is output. In the first control condition inspection unit 121, when the absolute value of Δp is equal to or more than the threshold value m (|Δp|≧m), the information (for example, "1") indicating that the drive waveform can be switched ("switchable"), in other words, that "ON→OFF" or "OFF→ON" of the second drive can be carried out is output as the result information (c11). Inversely, when the absolute value of Δp is less than m (|Δp|<m), the information (for example, "0") indicating that the drive waveform cannot be switched ("unchangeable"), in other words, that "ON→OFF" or "OFF→ON" of the second drive cannot be carried out is output as the result information (c12).

For example, in a first case of OFF condition determination using the first threshold value (k1), the first control condition inspection unit 121 outputs the information indicating that ON to OFF is "switchable" as the result information (c11) in the case of |Δp|≧m1, and outputs the information indicating that ON to OFF is "unswitchable" as the result information (c12) in the case of |Δp|<m1. Also in a second case of ON condition determination using the second threshold value (k2), processes are approximately the same.

In this example, by using the average APL as the determination condition instead of APL, the response sensitivity with respect to rapid change of the load in a short period is reduced and flexible control can be achieved. Since the inclination of the average APL variation is equal to or more than m at open-circle marks in FIG. 9, switching of Ron→Roff is carried out. Since the inclination is less than m at triangular marks, Roff is kept and unchanged. Since the inclination is equal to or more than m at rectangular marks, switching of Roff→Ron is carried out. The same goes for FIGS. 10 and 11 described later.

As described above, by virtue of the control using the APL variation value (q) and the threshold value (m), hunting of ON/OFF does not occur even at the positions like s11 and s12 corresponding to h1 and h2 of FIG. 12, and flexible variation is achieved.

Second Embodiment

Figure 10:
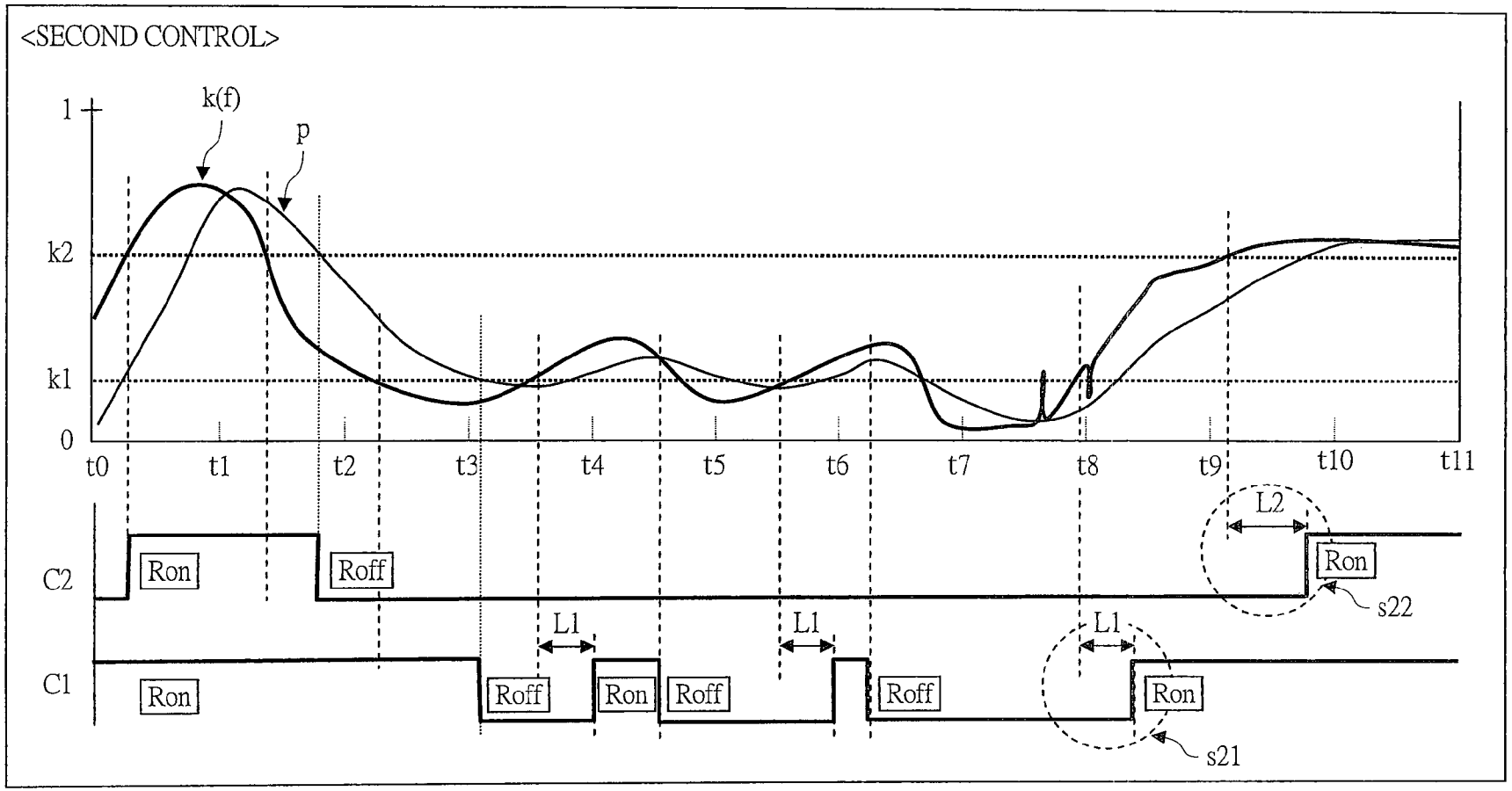
FIG. 10 is a drawing showing an example of the second control in a PDP apparatus according to a second embodiment of the present invention.

A second embodiment of the present invention will be described with reference to FIG. 10. The second embodiment has the same basic configuration as the first embodiment and is characterized in that, in addition to the first control of the first embodiment, the condition determination in accordance with time limit is added as the second control, that is, as an inspection of a second control condition relating to the APL variation value (q).

<Second Control>

The second control in the PDP apparatus according to the second embodiment will be described with reference to FIG. 10. An example of the APL information and ON/OFF control in the second control is shown in the same manner as the first embodiment. L (L1, L2) are time limit values relating to the determination of ON/OFF of the second drive (inspection of the second control condition) in the second control and show examples of the values used in the determination of transition of the second drive from ON to OFF (OFF condition determination).

In the second control, in the second control condition inspection unit 122 of FIG. 7 described above, based on the result of comparison of the APL information (k(f)) with the threshold values (k1, k2) and the time limit values (L1, L2), the control of the second drive is switched. In the second control condition inspection unit 122, as the determination for switching the second drive from ON to OFF, when the state where k(f) is equal to or more than the first threshold value k1 continues for a field period corresponding to the first time limit value L1 (k≧k1: continues for L1), the drive waveform "switchable" ("1") is output as the result information (c21). Also, when the state where k(f) is equal to or more than the second threshold value k2 continues for a field period corresponding to the second time limit value L2 (k≧k2: continues for L2), the drive waveform "switchable" ("1") is output as the result information (c22). When the above-described conditions are not satisfied, "unswitchable" ("0") is output as the result information (c23).

A control method different from that described above can be employed in the manner described below. In the second control condition inspection unit 122, when the state where k(f) is equal to or less than the first threshold value k1 continues for a field period corresponding to the first time limit value L1 (k≦k1: continues for L1), the drive waveform "switchable" is output as the result information (c21). Also, when the state where k(f) is equal to or less than the second threshold value k2 continues for a field period corresponding to the second time limit L2 (k≦k2: continues for L2), the drive waveform "switchable" is output as the result information (c22). In the cases other than those, "unswitchable" ("0") is output as the result information (c23).

As described above, by virtue of the control using the time limit values (L), even at the positions like s21 and s22 corresponding to h1 and h2 of FIG. 12, hunting of ON/OFF does not occur, and flexible variation is achieved.

Third Embodiment

Figure 11:
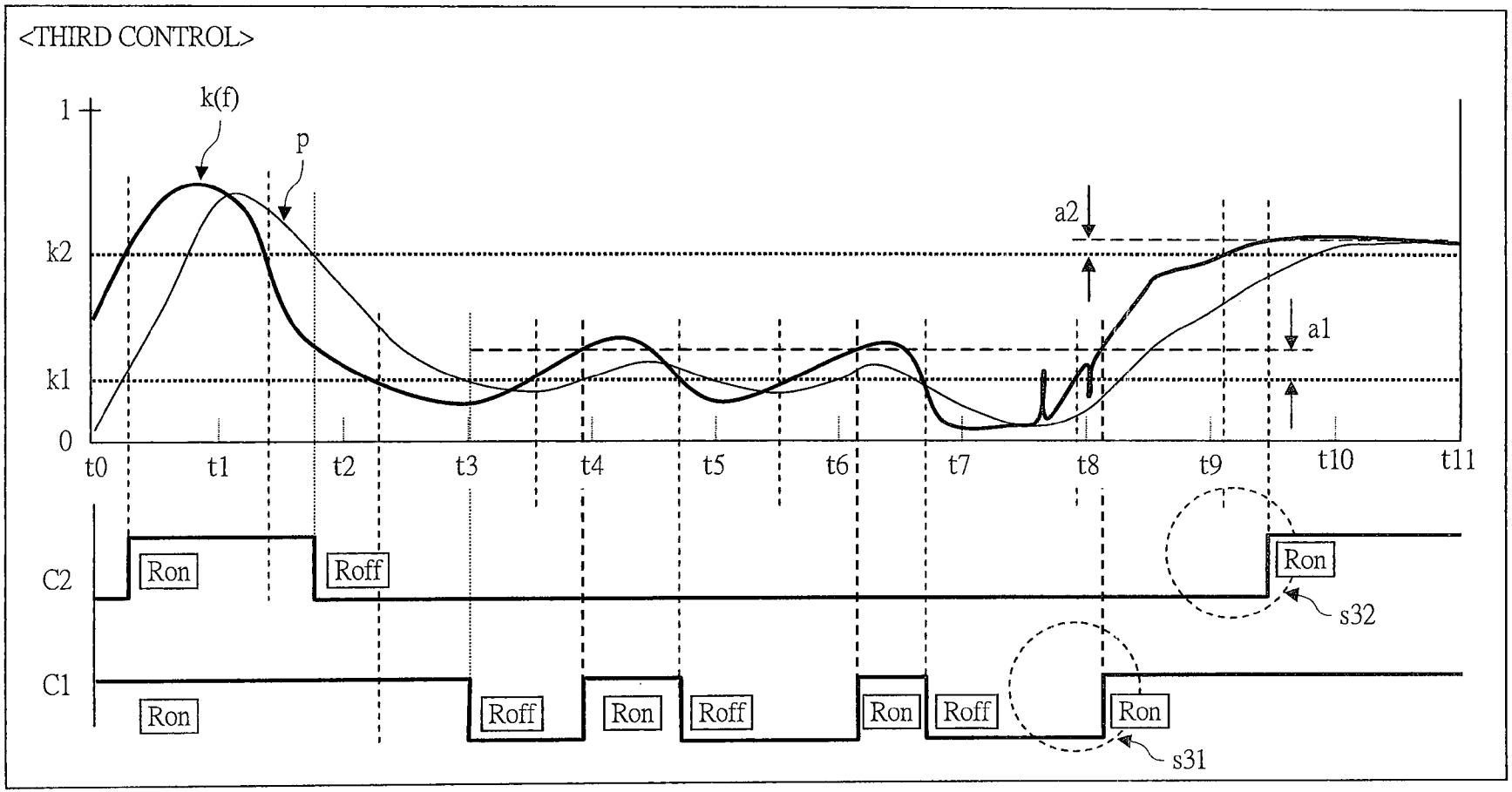
FIG. 11 is a drawing showing an example of a third control in a PDP apparatus according to a third embodiment of the present invention.

A third embodiment of the present invention will be described with reference to FIG. 11 and others. The third embodiment has the same basic configuration as the first embodiment and is characterized in that, in addition to the control of the first embodiment, the condition determination in accordance with the limit of a cumulative value instead of time is added as third control, that is, as an inspection of a third control condition relating to the APL variation value (q).

<Third Control>

The third control in the PDP apparatus according to the third embodiment will be described with reference to FIG. 11. An example of the APL information and ON/OFF control in the third control is shown in the same manner as the first embodiment. a (a1, a2) are threshold limit values (cumulative limit values) defining the limits of deviation of the cumulative value of APL from the threshold values (k1, k2). The range of the threshold values relating to the cumulative value of APL corresponds to the size of a. a1 represents a first threshold limit value determining the range of the first threshold value (k1), and a2 is a second threshold limit value determining the range of the second threshold value (k2).

In the third control condition inspection unit 123, when the absolute value of the difference between k(f) and the first threshold value k1 is equal to or more than the first threshold limit value a1 (|k−k1|≧a1), the drive waveform "switchable" is output as the result information (c31). Also, when the absolute value of the difference between k(f) and the second threshold value k2 is equal to or more than the second threshold limit value a2 ($|k-k2| \geqq a2$), the drive waveform "switchable" is output as the result information (c32). When the above-described conditions are not satisfied, "unswitchable" is output as the result information (c33).

As described above, by virtue of the control using the threshold limits (a), even at the positions like s31 and s32 corresponding to h1 and h2 of FIG. 12, hunting of ON/OFF does not occur, and flexible variation is achieved.

<Setting>

Next, an example of settings relating to above-described various controls will be described with reference to FIG. 6. In the above-described embodiments, threshold values and others of the corresponding controls can be set in advance and can be changed in accordance with needs from the setting unit 140 to the drive waveform control unit 116, the inspection units (121 to 123) and others of the control circuit 110.

As shown in (c), as the setting (first setting) of the targets of the second drive, the low-luminance SFs (SF #1 to SF #5) as shown in (b) are set to be excluded ("0") from the targets of the second drive. Also, the above-described high-luminance SFs (SF #6 to SF #10) are set to be the targets ("1") of the second drive. In the case of this first setting, the first drive is always ON (second drive is OFF) in the low-luminance SFs. In addition, as shown in (d), as the setting (second setting) of the targets of the second drive, the low-luminance SFs can be separately set as the targets ("1") of the second drive. In the case of this second setting, the second drive becomes ON even in the low-luminance SFs. For example, these two settings can be selected by a switch.

Also, as shown in (h) to (j), as examples of the settings of the threshold values (m, L, a) of the control conditions of the corresponding control, the same set values (m#g1, L#g1, a#g1) are uniformly set to the group g1 of the SFs (#1 to #5) in the low-luminance SFs. Further, set values (m#6 to m#10, L#6 to L#10, a#6 to a#10) are individually set to the SFs (#6 to #10) in the high-luminance SFs. By using the set threshold values in accordance with the SFs 30 in the determination of the control conditions, more flexible control can be achieved.

In the foregoing, the invention made by the inventor of the present invention has been concretely described based on the embodiments. However, it is needless to say that the present invention is not limited to the foregoing embodiments and various modifications and alterations can be made within the scope of the present invention.

INDUSTRIAL APPLICABILITY

The present invention can be utilized for a plasma display apparatus.

The invention claimed is:

1. A plasma display apparatus comprising: a plasma display panel which has a display region formed by a group of cells including a group of electrodes; and a circuit unit for driving and controlling the group of electrodes of the plasma display panel, wherein:

in drive control of a field period corresponding to the display region of the plasma display panel, the field period has a plurality of sub fields divided in accordance with weighting of luminance for grayscale expression, and each sub field has periods and operations of reset, address, and sustain, as basic control, when a load ratio which is a ratio of lighting cells of the sub field is other than zero, drive in which the period and operation of the reset of the sub field are not thinned is carried out as first drive, and when the load ratio is zero, drive in which at least a part of the period and operation of the reset of the sub field is thinned is carried out as second drive, based on display data, an APL (average luminance level) value (k) of each field period is detected or calculated, and an APL variation value (q) which is a variation of the APL value (k) in a certain period including the field period is further calculated, and when the APL variation value (q) is less than a predetermined threshold value, even when the load ratio is changed from zero to a value other than zero between continuous sub fields in the field period, execution of the second drive is continued without starting execution of the first drive by giving higher priority than the basic control.

2. The plasma display apparatus according to claim 1, wherein, based on an average APL value (p) which is an average value of the APL value (k) in a plurality of field periods, an average APL variation value ($\Delta p$) which is a variation of the average APL value (p) in a certain period including the plurality of continuous field periods is calculated and used as the APL variation value (q), and when the average APL variation value ($\Delta p$) is less than a first threshold value (m) ($0<m<1$), even when the load ratio is changed from zero to a value other than zero between the continuous sub fields in the field period, execution of the second drive is continued without starting execution of the first drive by giving higher priority than the basic control.

3. The plasma display apparatus according to claim 2, wherein, in a case where a state where the APL variation value (q) is less than the first threshold value (m) continues and execution of the second drive continues, when predetermined limit time (L) elapses from a point when the load ratio is changed from zero to a value other than zero between the sub fields, immediately thereafter, execution of the second drive in the sub field is automatically cancelled.

4. The plasma display apparatus according to claim 3, wherein the circuit unit has means for setting the limit time (L) in units of the sub field or in units of group including a plurality of continuous sub fields.

5. The plasma display apparatus according to claim 2, wherein, in a case where a state where the APL variation value (q) is less than the first threshold value (m) continues and execution of the second drive continues, when a cumulative value of the APL variation value (q) exceeds a predetermined threshold limit (a) from the first threshold value (m), immediately thereafter, execution of the second drive in the sub field is automatically cancelled.

6. The plasma display apparatus according to claim 5, wherein the circuit unit has means for setting the threshold limit (a) in units of the sub field or in units of group including a plurality of continuous sub fields.

7. The plasma display apparatus according to claim 2, wherein, in a case where a state where the APL variation value (q) is less than the first threshold value (m) continues and execution of the second drive continues, when predetermined limit time (L) elapses from a point when the load ratio is changed from zero to a value other than zero between the sub fields or when a cumulative value of the APL variation value (q) exceeds a predetermined threshold limit (a) from the first threshold value (m), immediately thereafter, execution of the second drive in the sub field is automatically cancelled.

8. The plasma display apparatus according to claim 2, wherein, in a case where a state where the APL variation value (q) is less than the first threshold value (m) continues and the second drive continues, when predetermined limit time (L) elapses from a point when the load ratio is changed from zero to a value other than zero between the sub fields and when a cumulative value of the APL variation value (q) exceeds a predetermined threshold limit (a) from the first threshold value (m), immediately thereafter, execution of the second drive in the sub field is automatically cancelled.

9. The plasma display apparatus according to claim 2, wherein the circuit unit has means for setting the first threshold value (m) in units of the sub field or in units of group including a plurality of continuous sub fields.

10. The plasma display apparatus according to claim 1, wherein, as the basic control, for one or more sub fields having luminance equal to or higher than predetermined luminance in the field period, when the load ratio of the sub fields is other than zero, drive in which the period and operation of the reset of the sub field are not thinned is carried out as first drive, and when the load ratio is zero, drive in which at least a part of the period and operation of the reset of the sub field is thinned is carried out as second drive.

11. The plasma display apparatus according to claim 1, wherein, in one or more sub fields having luminance equal to or lower than predetermined luminance in the field period, regardless of the load ratio of the sub field, the second drive is not executed.

12. The plasma display apparatus according to claim 1, wherein, in one or more sub fields having luminance equal to or lower than predetermined luminance in the field period, regardless of the load ratio of the sub field, the second drive is always executed.

13. The plasma display apparatus according to claim 1, further comprising:

means for selectively setting non-execution of the second drive and execution of the second drive regardless of the load ratio of the sub field in one or more sub fields having luminance equal to or lower than predetermined luminance in the field period.

14. A plasma display apparatus comprising: a plasma display panel which has a display region formed by a group of cells including a group of electrodes; and a circuit unit for driving and controlling the group of electrodes of the plasma display panel, wherein:

in drive control of a field period corresponding to the display region of the plasma display panel, the field period has a plurality of sub fields divided in accordance with weighting of luminance for grayscale expression, and each sub field has periods and operations of reset, address, and sustain, as basic control, when a load ratio which is a ratio of lighting cells of the sub field is other than zero, drive in which the period and operation of the reset of the sub field are not thinned is carried out as first drive, and when the load ratio is zero, drive in which at least a part of the period and operation of the reset of the sub field is thinned is carried out as second drive, based on display data, an APL value (k) of each field period is detected or calculated, and an APL variation value (q) which is a variation of the APL value (k) in a certain period including the field period is further calculated, and when the APL variation value (q) is less than a predetermined threshold value, even when the load ratio is changed from zero to a value other than zero between continuous sub fields in the field period, execution of the first drive is continued without starting execution of the second drive by giving higher priority than the basic control.

* * * * *